US008191658B2

(12) United States Patent
Schmitz et al.

(10) Patent No.: US 8,191,658 B2
(45) Date of Patent: Jun. 5, 2012

(54) CUTTING ELEMENTS HAVING DIFFERENT INTERSTITIAL MATERIALS IN MULTI-LAYER DIAMOND TABLES, EARTH-BORING TOOLS INCLUDING SUCH CUTTING ELEMENTS, AND METHODS OF FORMING SAME

(75) Inventors: Kurtis Schmitz, Yukon, OK (US); Danny E. Scott, Montgomery, TX (US)

(73) Assignee: Baker Hughes Incorporated, Houston, TX (US)

( * ) Notice: Subject to any disclaimer, the term of this patent is extended or adjusted under 35 U.S.C. 154(b) by 193 days.

(21) Appl. No.: 12/544,954

(22) Filed: Aug. 20, 2009

(65) Prior Publication Data

US 2011/0042148 A1 Feb. 24, 2011

(51) Int. Cl.
*E21B 10/36* (2006.01)

(52) U.S. Cl. ..... 175/434; 76/108.2; 175/420.2; 175/428; 175/433; 51/293; 51/307

(58) Field of Classification Search ..... 175/420.2, 175/428, 434, 433
See application file for complete search history.

(56) References Cited

U.S. PATENT DOCUMENTS

| | | | | |
|---|---|---|---|---|
| 2,941,248 | A | | 6/1960 | Hall |
| 4,124,401 | A | | 11/1978 | Lee et al. |
| 4,151,686 | A | | 5/1979 | Lee et al. |
| 4,167,399 | A | | 9/1979 | Lee et al. |
| 4,224,380 | A | | 9/1980 | Bovenkerk et al. |
| 4,241,135 | A | | 12/1980 | Lee et al. |
| 4,288,248 | A | | 9/1981 | Bovenkerk et al. |
| 4,766,040 | A | | 8/1988 | Hillert et al. |
| 4,798,026 | A | * | 1/1989 | Cerceau ..... 451/540 |
| 4,844,988 | A | | 7/1989 | Ishizuka et al. |
| 5,127,923 | A | | 7/1992 | Bunting et al. |
| 5,217,081 | A | | 6/1993 | Waldenstrom et al. |
| 5,264,283 | A | | 11/1993 | Waldenstrom et al. |
| 5,335,738 | A | | 8/1994 | Waldenstrom et al. |
| 5,441,817 | A | | 8/1995 | Rai |
| 5,496,638 | A | | 3/1996 | Waldenstrom et al. |
| 5,624,068 | A | | 4/1997 | Waldenstrom et al. |
| 6,342,301 | B1 | | 1/2002 | Yoshida et al. |
| 6,562,462 | B2 | | 5/2003 | Griffin et al. |
| 6,585,064 | B2 | | 7/2003 | Griffin et al. |

(Continued)

FOREIGN PATENT DOCUMENTS

JP 59219500 12/1984

OTHER PUBLICATIONS

International Search Report for International Application No. PCT/US2010/045789 mailed Mar. 29, 2011, 3 pages.

(Continued)

*Primary Examiner* — Cathleen Hutchins
(74) *Attorney, Agent, or Firm* — TraskBritt

(57) ABSTRACT

Methods of forming cutting elements for earth-boring tools include providing a barrier material between a first powder and a second powder each comprising diamond grains, and subjecting the powders and barrier material to high temperature and high pressure conditions to form polycrystalline diamond material. The formation of the polycrystalline diamond material is catalyzed, and catalytic material may be hindered from migrating across the layer of barrier material. Cutting elements for use in earth-boring tools include a barrier material disposed between a first layer of polycrystalline diamond material and a second layer of polycrystalline diamond material. Earth-boring tools include one or more such cutting elements for cutting an earth formation.

35 Claims, 5 Drawing Sheets

U.S. PATENT DOCUMENTS

| | | | | |
|---|---|---|---|---|
| 6,589,640 | B2 | 7/2003 | Griffin et al. | |
| 6,592,985 | B2 | 7/2003 | Griffin et al. | |
| 6,601,662 | B2 | 8/2003 | Matthias et al. | |
| 6,739,214 | B2 | 5/2004 | Griffin et al. | |
| 6,749,033 | B2 | 6/2004 | Griffin et al. | |
| 6,797,326 | B2 | 9/2004 | Griffin et al. | |
| 6,861,098 | B2 | 3/2005 | Griffin et al. | |
| 6,861,137 | B2 | 3/2005 | Griffin et al. | |
| 6,878,447 | B2 | 4/2005 | Griffin et al. | |
| 7,517,589 | B2 | 4/2009 | Eyre | |
| 7,575,805 | B2 | 8/2009 | Achilles et al. | |
| 8,034,136 | B2 * | 10/2011 | Sani | 51/293 |
| 2005/0115744 | A1 | 6/2005 | Griffin et al. | |
| 2005/0263328 | A1 | 12/2005 | Middlemiss | |
| 2006/0060390 | A1 | 3/2006 | Eyre | |
| 2006/0060391 | A1 | 3/2006 | Eyre et al. | |
| 2006/0162969 | A1 * | 7/2006 | Belnap et al. | 175/433 |
| 2007/0039762 | A1 | 2/2007 | Achilles | |
| 2007/0144790 | A1 | 6/2007 | Fang et al. | |
| 2007/0181348 | A1 | 8/2007 | Lancaster et al. | |
| 2008/0073126 | A1 | 3/2008 | Shen et al. | |
| 2008/0179109 | A1 | 7/2008 | Belnap et al. | |
| 2008/0206576 | A1 | 8/2008 | Qian et al. | |
| 2008/0302579 | A1 | 12/2008 | Keshavan et al. | |
| 2009/0090563 | A1 | 4/2009 | Voronin et al. | |

OTHER PUBLICATIONS

International Written Opinion for International Application No. PCT/US2010/045789 mailed Mar. 29, 2011, 3 pages.

* cited by examiner

CUTTING ELEMENTS HAVING DIFFERENT INTERSTITIAL MATERIALS IN MULTI-LAYER DIAMOND TABLES, EARTH-BORING TOOLS INCLUDING SUCH CUTTING ELEMENTS, AND METHODS OF FORMING SAME

TECHNICAL FIELD

Embodiments of the present invention generally relate to cutting elements that include a table of superabrasive material (e.g., diamond or boron nitride) formed on a substrate, to earth-boring tools including such cutting elements, and to methods of forming such cutting elements and earth-boring tools.

BACKGROUND

Earth-boring tools for forming wellbores in subterranean earth formations may include a plurality of cutting elements secured to a body. For example, fixed-cutter earth-boring rotary drill bits (also referred to as "drag bits") include a plurality of cutting elements that are fixedly attached to a bit body of the drill bit. Similarly, roller cone earth-boring rotary drill bits may include cones that are mounted on bearing pins extending from legs of a bit body such that each cone is capable of rotating about the bearing pin on which it is mounted. A plurality of cutting elements may be mounted to each cone of the drill bit.

The cutting elements used in such earth-boring tools often include polycrystalline diamond cutters (often referred to as "PDCs"), which are cutting elements that include a polycrystalline diamond (PCD) material. Such polycrystalline diamond cutting elements are formed by sintering and bonding together relatively small diamond grains or crystals under conditions of high temperature and high pressure in the presence of a catalyst (such as, for example, cobalt, iron, nickel, or alloys and mixtures thereof) to form a layer of polycrystalline diamond material on a cutting element substrate. These processes are often referred to as high temperature/high pressure (or "HTHP") processes. The cutting element substrate may comprise a cermet material (i.e., a ceramic-metal composite material) such as, for example, cobalt-cemented tungsten carbide. In such instances, the cobalt (or other catalyst material) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HTHP process.

Upon formation of a diamond table using an HTHP process, catalyst material may remain in interstitial spaces between the grains or crystals of diamond in the resulting polycrystalline diamond table. The presence of the catalyst material in the diamond table may contribute to thermal damage in the diamond table when the cutting element is heated during use due to friction at the contact point between the cutting element and the formation. Polycrystalline diamond cutting elements in which the catalyst material remains in the diamond table are generally thermally stable up to a temperature of about 750° Celsius, although internal stress within the polycrystalline diamond table may begin to develop at temperatures exceeding about 350° Celsius. This internal stress is at least partially due to differences in the rates of thermal expansion between the diamond table and the cutting element substrate to which it is bonded. This differential in thermal expansion rates may result in relatively large compressive and tensile stresses at the interface between the diamond table and the substrate, and may cause the diamond table to delaminate from the substrate. At temperatures of about 750° Celsius and above, stresses within the diamond table may increase significantly due to differences in the coefficients of thermal expansion of the diamond material and the catalyst material within the diamond table itself. For example, cobalt thermally expands significantly faster than diamond, which may cause cracks to form and propagate within the diamond table, eventually leading to deterioration of the diamond table and ineffectiveness of the cutting element.

In order to reduce the problems associated with different rates of thermal expansion in polycrystalline diamond cutting elements, so-called "thermally stable" polycrystalline diamond (TSD) cutting elements have been developed. Such a thermally stable polycrystalline diamond cutting element may be formed by leaching the catalyst material (e.g., cobalt) out from interstitial spaces between the diamond grains in the diamond table using, for example, an acid. All of the catalyst material may be removed from the diamond table, or only a portion may be removed. Thermally stable polycrystalline diamond cutting elements in which substantially all catalyst material has been leached from the diamond table have been reported to be thermally stable up to temperatures of about 1200° Celsius. It has also been reported, however, that such fully leached diamond tables are relatively more brittle and vulnerable to shear, compressive, and tensile stresses than are non-leached diamond tables. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which only a portion of the catalyst material has been leached from the diamond table.

BRIEF SUMMARY

In some embodiments, the present invention includes methods of forming a cutting element for an earth-boring tool in which a barrier material is provided between a first powder and a second powder each comprising diamond grains. The barrier material, the first powder, and the second powder are subjected to high temperature and high pressure conditions to form a first layer of polycrystalline diamond material from the first powder and a second layer of polycrystalline diamond material from the second powder. The formation of at least the first layer of polycrystalline diamond material from the first powder is catalyzed using catalytic material, and the catalytic material is hindered from migrating across the layer of barrier material.

In additional embodiments, the present invention includes methods of forming a cutting element in which a multi-layer diamond table is formed on a surface of a substrate. Forming the multi-layer diamond table includes separating a first layer of diamond powder and a second layer of diamond powder with a layer of barrier material, and subjecting the first layer of diamond powder, the second layer of diamond powder, and the layer of barrier material to high temperature and high pressure conditions to form a first layer of polycrystalline diamond material from the first layer of diamond powder and a second layer of polycrystalline diamond material from the second layer of diamond powder. The formation of the first layer of polycrystalline diamond material and the second layer of polycrystalline diamond material is catalyzed using at least one catalytic material. Catalytic material is removed from interstitial spaces between diamond crystals in the second layer of polycrystalline diamond material, and the interstitial spaces between diamond crystals in the second layer of polycrystalline diamond material are infiltrated with an at least substantially inert material.

In yet further embodiments, the present invention includes cutting elements for use in earth-boring tools that include a cutting element substrate, a first layer of polycrystalline diamond material on the cutting element substrate, a second layer of polycrystalline diamond material on a side of the first layer of polycrystalline diamond material opposite the cutting element substrate, and a barrier layer disposed between the first layer of polycrystalline diamond material and the second layer of polycrystalline diamond material. The first layer of polycrystalline diamond material includes catalytic material in interstitial spaces between diamond crystals in the first layer of polycrystalline diamond material, and the second layer of polycrystalline diamond material includes an at least substantially inert material in interstitial spaces between diamond crystals in the second layer of polycrystalline diamond material.

In additional embodiments, the present invention includes cutting elements for use in earth-boring tools that include a multi-layer diamond table on a surface of a cutting element substrate. The multi-layer diamond table includes a barrier layer separating a first layer of polycrystalline diamond material and a second layer of polycrystalline diamond material. Catalytic material is disposed in interstitial spaces between diamond crystals in the first layer of polycrystalline diamond material, and an at least substantially inert material is disposed in interstitial spaces between diamond crystals in the second layer of polycrystalline diamond material.

Further embodiments of the present invention include earth-boring tools that include such cutting elements. For example, embodiments of the present invention include earth-boring tools having a body and at least one polycrystalline diamond cutting element attached to the body. The polycrystalline diamond cutting element includes a first layer of polycrystalline diamond material on a cutting element substrate, a second layer of polycrystalline diamond material on a side of the first layer of polycrystalline diamond material opposite the cutting element substrate, and a barrier layer disposed between the first layer of polycrystalline diamond material and the second layer of polycrystalline diamond material. The first layer of polycrystalline diamond material includes catalytic material in interstitial spaces between diamond crystals in the first layer of polycrystalline diamond material, and the second layer of polycrystalline diamond material includes an at least substantially inert material in interstitial spaces between diamond crystals in the second layer of polycrystalline diamond material.

BRIEF DESCRIPTION OF THE SEVERAL VIEWS OF THE DRAWINGS

While the specification concludes with claims particularly pointing out and distinctly claiming that which is regarded as the present invention, the advantages of this invention may be more readily ascertained from the description of embodiments of the invention when read in conjunction with the accompanying drawings, in which:

DETAILED DESCRIPTION OF THE INVENTION

Some of the illustrations presented herein are not meant to be actual views of any particular material or device, but are merely idealized representations which are employed to describe the present invention. Additionally, elements common between figures may retain the same numerical designation.

In some embodiments, embodiments of methods of the present invention may be used to fabricate cutting elements that include a multi-layer diamond table comprising polycrystalline diamond material. The methods employ the use of a barrier layer in the diamond material used to form the diamond table to hinder the migration or diffusion of matter across the barrier layer. The diamond table may be farmed using a high temperature and high pressure (HTHP) process. In some embodiments, the diamond table may be formed on a cutting element substrate, or the diamond table may be formed separately from any cutting element substrate and later attached to a cutting element substrate.

Figure 1:
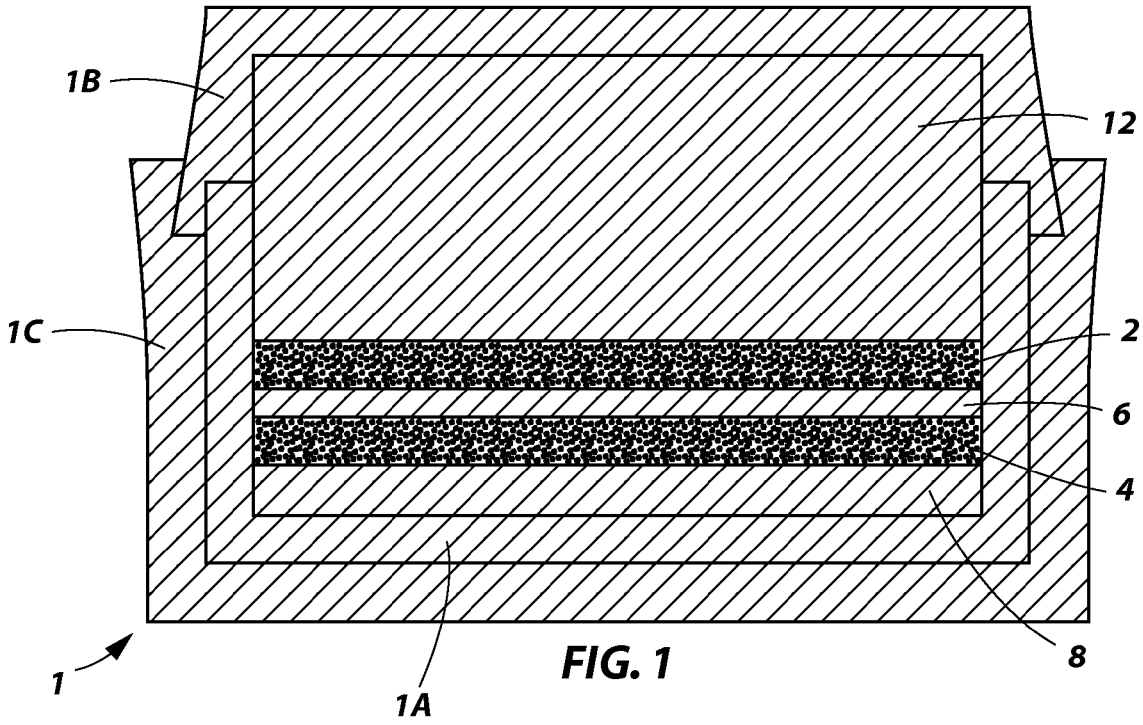
FIG. 1 is a cross-sectional view of a partially formed cutting element and is used to describe embodiments of methods of the present invention that may be used to form embodiments of cutting elements of the present invention.

Referring to FIG. 1, a container 1 may be provided, and a first powder 2, a second powder 4, and a barrier layer 6 may be provided within the container 1. The container 1 may include one or more generally cup-shaped members, such as the cup-shaped member 1A, the cup-shaped member 1B, and the cup-shaped member 1C, that may be assembled and swaged and/or welded together to form the container 1. The first powder 2, second powder 4, and the barrier layer 6 may be disposed within the inner cup-shaped member 1A, as shown in FIG. 1, which has a circular end wall and a generally cylindrical lateral side wall extending perpendicularly from the circular end wall, such that the inner cup-shaped member 1A is generally cylindrical and includes a first closed end and a second, opposite open end.

The barrier layer 6 may be formed to comprise a relatively thin disc, film, or foil of continuous, solid barrier material, as shown in FIG. 1. As used herein, the term "barrier material" means and includes any material disposed between diamond grains that hinders (e.g., slows, impedes, prevents, etc.) the flow of at least one of an etchant and a catalyst material through interstitial spaces between the diamond grains. In other embodiments, the barrier layer 6 may be formed to comprise a relatively thin discontinuous disc, film, or foil of solid barrier material, such as a perforated disc, a mesh, or a screen of barrier material. In other embodiments, the barrier layer 6 may be formed to comprise a powder that includes particles of barrier material.

A substrate 12 also may be provided at least partially within the container 1. The first powder 2 may be provided adjacent a surface of a substrate 12, the second powder 4 may be provided on a side of the first powder 2 opposite the substrate 12, and the barrier layer 6 may be provided between the first powder 2 and the second powder 4, as shown in FIG. 1.

At least the first powder 2 and the second powder 4 include diamond crystals or grains. As previously mentioned, the barrier layer 6 may comprise a powder that includes barrier material, and such a powdered barrier layer 6 also may include diamond crystals or grains.

To catalyze the formation of inter-granular bonds between the diamond grains in the first powder 2 and the second powder 4 during an HTHP process, the diamond grains in the first powder 2 and the second powder 4 may be physically exposed to catalyst material during the HTHP process. In other words, catalyst material may be provided in each of the first powder 2 and the second powder 4 prior to commencing the HTHP process, or catalyst material may be allowed or caused to migrate into each of the first powder 2 and the second powder 4 from one or more sources of catalyst material during the HTHP process.

For example, the first powder 2 optionally may include particles comprising a catalyst material (such as, for example, the cobalt in cobalt-cemented tungsten carbide). However, if the substrate 12 includes a catalyst material, the catalyst material may be swept from the surface of the substrate 12 into the first powder 2 during sintering and catalyze the formation of inter-granular diamond bonds between the diamond grains in the first powder 2. In such instances, it may not be necessary or desirable to include particles of catalyst material in the first powder 2.

The second powder 4 also, optionally, may further include particles of catalyst material. In some embodiments, however, a catalyst structure 8 that includes a catalyst material (such as, for example, cobalt) may be provided on a side of the second powder 4 opposite the barrier layer 6 prior to and during sintering. The catalyst structure 8 may comprise a solid cylinder or disc that includes catalyst material, and may have a material composition similar to the substrate 12. In such embodiments, catalyst material may be swept from the catalyst structure 8 into the second powder 4 during sintering and catalyze the formation of inter-granular diamond bonds between the diamond grains in the second powder 4. In such instances, it may not be necessary or desirable to include particles of catalyst material in the second powder 4. In some embodiments, the catalyst material used to catalyze the formation of inter-granular diamond bonds between the diamond grains in the second powder 4 may be different from the catalyst material used to catalyze the formation of inter-granular diamond bonds between the diamond grains in the first powder 2. In other words, the catalyst structure 8 may have a different composition from, and comprise a different catalyst material than, the substrate 12.

Inter-granular bonds of the diamond grains in the barrier layer 6, if present, may be catalyzed by catalyst material in the first powder 2 and the second powder 4 during the HTHP process. For example, inter-granular bonds of the diamond grains in the barrier layer 6 on the side thereof adjacent the first powder 2 may be catalyzed by catalyst material in the first powder 2, and inter-granular bonds of the diamond grains in the barrier layer 6 on the side thereof adjacent the second powder 4 may be catalyzed by catalyst material in the second powder 4.

By way of example, the diamond grains in the first powder 2 and the second powder 4 may have an average particles size of about one hundred fifty microns (150 μm) or less, or more particularly, about forty microns (40 μm) or less. The diamond grains in the first powder 2 may have an average particle size that is the same as, or that differs from, an average particle size of the diamond grains in the second powder 4. In some embodiments, the diamond grains in the first powder 2 may have an average particle size that is greater than an average particle size of the diamond grains in the second powder 4. As a non-limiting example, the diamond grains in the first powder 2 may have an average particle size that is between about fifteen microns (15 μm) and about twenty-five microns (25 μm) (e.g., about twenty microns (25 μm)), and the diamond grains in the second powder 4 may have an average particle size that is between about five microns (5 μm) and about fifteen microns (15 μm) (e.g., about ten microns (25 μm)).

The diamond grains in the barrier layer 6, if present, may have an average particle size that is at least substantially equal to an average particle size of one or both of the diamond grains in the first powder 2 and the diamond grains in the second powder 4. In other embodiments, the diamond grains in the barrier layer 6, if present, may have an average particle size that is different from both the average particle size of the diamond grains in the first powder 2 and the average particle size of the diamond grains in the second powder 4. For example, diamond grains in the barrier layer 6 may have an average particle size that is between an average particle size of the diamond grains in the first powder 2 and an average particle size of the diamond grains in the second powder 4.

After providing the first powder 2, the second powder 4, and the barrier layer 6 within the container 1 as shown in FIG. 1, the assembly optionally may be subjected to a cold pressing process to compact the first powder 2, the second powder 4, and the barrier layer 6 (and, optionally, the substrate 12 and the catalyst structure 8) in the container 1.

Figure 2:
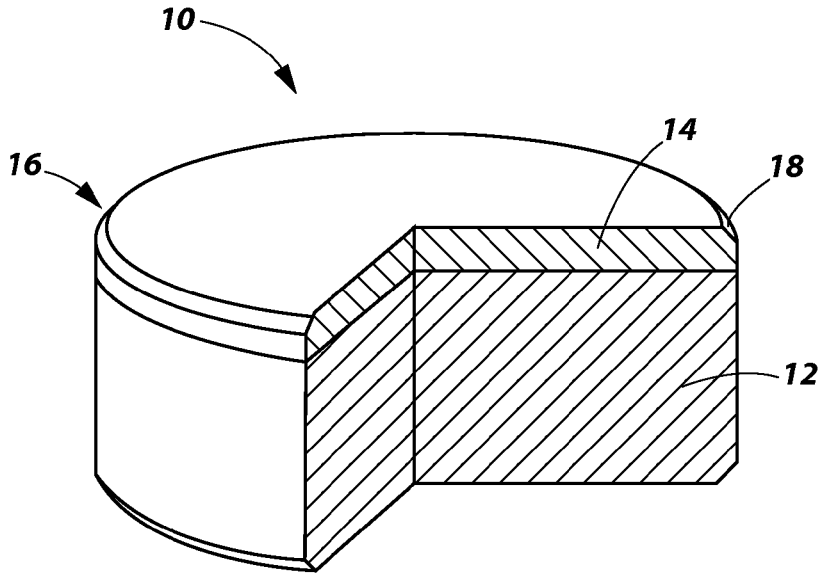
FIG. 2 is a partially cut-away perspective view of an embodiment of a cutting element of the present invention.
Figure 3:
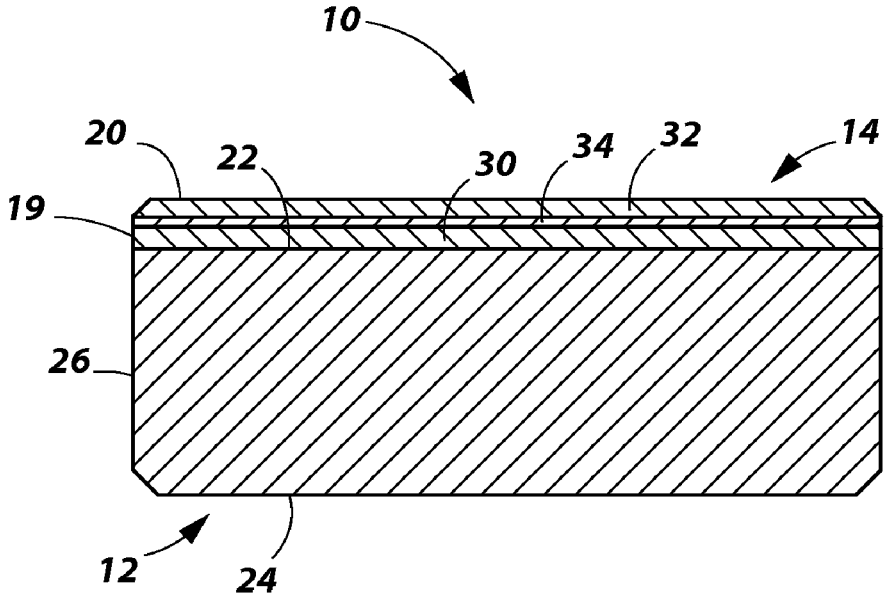
FIG. 3 is an enlarged cross-sectional view of the cutting element shown in FIG. 2.

The resulting assembly then may be sintered in an HTHP process in accordance with procedures known in the art to form a cutting element 10 having a multi-layer diamond table like the cutting element 10 and multi-layer diamond table 14, as shown in FIGS. 2 and 3 and described in further detail herein below. Referring to FIGS. 1 and 3 together, the first powder 2 (FIG. 1) may form a first layer of polycrystalline diamond material 30 (FIG. 3) in the multi-layer diamond table 14 on the substrate 12, and the second powder 4 (FIG. 1) may form a second layer of polycrystalline diamond material 32 (FIG. 3) in the multi-layer diamond table 14 (FIG. 3). Similarly, the barrier layer 6 (FIG. 1) provided between the first powder 2 and the second powder 4 may form a barrier layer 34 (FIG. 3) in the resulting multi-layer diamond table 14 (FIG. 3).

Although the exact operating parameters of HTHP processes will vary depending on the particular compositions and quantities of the various materials being sintered, the pressures in the heated press may be greater than about five gigapascals (5.0 GPa) and the temperatures may be greater than about fifteen hundred degrees Celsius (1,500° C.). In some embodiments, the pressures in the heated press may be greater than about 6.7 GPa. Furthermore, the materials being sintered may be held at such temperatures and pressures for between about thirty seconds (30 sec.) and about twenty minutes (20 min.).

During sintering, the barrier material in the barrier layer 6 may serve to hinder diffusion, or selectively control the rate of diffusion of catalyst material in the first powder 2 into the second powder 4, and may serve to hinder diffusion, or selectively control the rate of diffusion of catalyst material in the second powder 4 into the first powder 2. By selectively controlling the amount of material (e.g., volume or weight) in each of the first powder 2, the second powder 4, and the barrier layer 6, the material composition of the barrier layer 6, the average thicknesses of the resulting layers or regions in a multi-layer diamond table may be selectively controlled.

In some embodiments, the barrier layer 6 may comprise a material having a structure and chemical composition selected such that the barrier material will not dissolve into any catalyst, binder, or any other material in either the first layer of polycrystalline diamond material 30 or the second layer of polycrystalline diamond material 32.

In other embodiments, however, the barrier layer 6 may comprise a material having a structure and chemical composition selected such that the barrier material will dissolve into another material in at least one of the first layer of polycrystalline diamond material 30 and the second layer of polycrystalline diamond material 32. For example, the barrier layer 6 may comprise a material that will dissolve into another material (e.g., a catalyst, binder, etc.) in at least one of the first layer of polycrystalline diamond material 30 and the second layer of polycrystalline diamond material 32 to form a solid solution in which the barrier material forms a solute. Furthermore, such dissolution of the barrier material into the material in the first layer of polycrystalline diamond material 30 and/or the second layer of polycrystalline diamond material 32 may occur at a selected point in the HTHP process (e.g., at a predetermined temperature). As another example, the barrier layer 6 may comprise a material that will react with another material in at least one of the first layer of polycrystalline diamond material 30 and the second layer of polycrystalline diamond material 32 to form a new material or phase such as, for example, a metal carbide material.

By way of example and not limitation, the barrier material may comprise a metal such as tantalum, titanium, tungsten, molybdenum, niobium, iron, or an alloy or mixture of such metals (e.g., steel or an iron-nickel alloy). In some embodiments, the barrier material may comprise a metal that will dissolve with cobalt, but that exhibits a higher melting point than cobalt.

After sintering the first powder 2, second powder 4, and the barrier layer 6 to form the multi-layer diamond table 14 shown in FIGS. 2 and 3, catalyst material, binder material, or any other material in the interstitial spaces between the diamond grains 40 (FIG. 5) in the second layer of polycrystalline diamond material 32 optionally may be removed from between the diamond grains 40 using, for example, an acid leaching process. Specifically, as known in the art and described more fully in U.S. Pat. No. 5,127,923 and U.S. Pat. No. 4,224,380, which are incorporated herein in their entirety by this reference, aqua regia (a mixture of concentrated nitric acid ($HNO_3$) and concentrated hydrochloric acid (HCl)) may be used to at least substantially remove catalyst material, binder material, or any other material from the interstitial voids between the diamond grains 40 in the second layer of polycrystalline diamond material 32. It is also known to use boiling hydrochloric acid (HCl) and boiling hydrofluoric acid (HF).

The resulting structure is a multi-layer diamond table 14 in which little to no material is present in the interstitial voids between diamond grains 40 in the second layer of polycrystalline diamond material 32. The leaching agent may be precluded from contacting the first layer of polycrystalline diamond material 30 during the leaching process by, for example, encasing the substrate 12 and the first layer of polycrystalline diamond material 30 in a plastic resin, by coating the substrate 12 and the exposed lateral side surfaces of the first layer of polycrystalline diamond material 30 with a masking material, or by the use of an elastomer seal resistant to the leaching agent, compressed against the lateral side surface 19 of the multi-layer diamond table 14 using a plastic fixture.

Referring again to FIG. 3, the barrier layer 34 in the multi-layer diamond table 14 also may serve as a barrier to a leaching agent or any other reagent used to remove catalyst material or other matter from the interstitial voids or spaces between diamond grains 40 in the second layer of polycrystalline diamond material 32 after formation of the diamond table 14. In other words, the barrier material in the barrier layer 34 may hinder a leaching agent or another reagent from removing catalyst material or other matter from the interstitial voids or spaces between diamond grains 40 in the first layer of polycrystalline diamond material 30 as the leaching agent or reagent is used to remove catalyst material or other matter from the interstitial voids or spaces between diamond grains 40 in the second layer of polycrystalline diamond material 32. As a result, the leaching depth may be selectively controlled by selectively controlling the location of the barrier layer 34 in the multi-layer diamond table 14.

Figure 5:
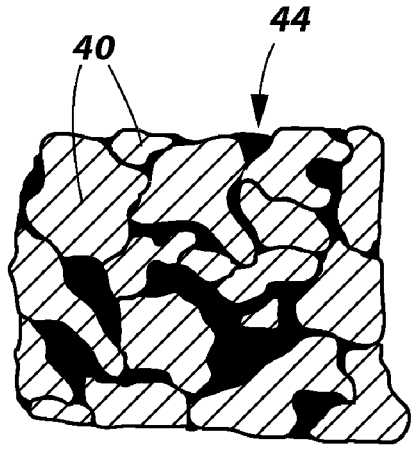
FIG. 5 is an enlarged view illustrating how a microstructure of a second layer or region of polycrystalline diamond material in the diamond table of the cutting element shown in FIGS. 2 and 3 may appear under magnification.

After leaching catalyst material, binder material, or any other material in the interstitial spaces between the diamond grains 40 in the second layer of polycrystalline diamond material 32, an interstitial material 44 (the shaded regions between the diamond crystals or grains 40) may be infiltrated into the interstitial spaces between the diamond grains 40 in the second layer of polycrystalline diamond material 32, as shown in FIG. 5. The interstitial material 44 may be different from the catalyst material used to catalyze the formation of inter-granular diamond bonds between the diamond grains 40 in the second layer of polycrystalline diamond material 32. The interstitial material 44 may be at least substantially comprised by one or more elements from groups other than Group VIIIA of the Periodic Table of the Elements. In other words, the second layer of polycrystalline diamond material 32 may be at least substantially free of elements from Group VIIIA of the Periodic Table of the Elements. By way of example, the interstitial material 44 may include an at least substantially inert material such as, for example, silicon, copper, silver, gold, and alloys and mixtures thereof. In additional embodiments, the interstitial material 44 may comprise a polymer material (e.g., an elastomeric thermosetting material, plastic, etc.), so-called "water glass," or any other inert material (e.g., an inert metal or non-metal) that is wettable to diamond and will flow into the interstitial spaces between diamond grains under capillary action with or without pressure assistance. As used herein, the term "inert material" refers to any material that does not catalyze the graphitization of diamond material within the temperature range extending from about 750° C. to about 2,000° C.

As previously mentioned, FIGS. 2 and 3 illustrate an embodiment of a cutting element 10 of the present invention that may be fabricated in accordance with embodiments of methods of the present invention, as previously described herein with reference to FIG. 1. FIG. 2 is a partially cut-away perspective view of the cutting element 10. The cutting element 10 includes a cutting element substrate 12 having a diamond table 14 thereon, although additional embodiments of the present invention comprise diamond tables, like the diamond table 14, which are not attached to any substrate like the substrate 12. With continued reference to FIG. 2, the diamond table 14 may be formed on the cutting element substrate 12, or the diamond table 14 and the substrate 12 may be separately formed and subsequently attached together. FIG. 3 is an enlarged cross-sectional view of the cutting element 10 shown in FIG. 2. As shown in FIG. 3, the diamond table 14 may have a chamfered edge 16. The chamfered edge 16 of the cutting element 10 has a single chamfer surface 18, although the chamfered edge 16 also may have additional chamfer surfaces, and such chamfer surfaces may be oriented at chamfer angles that differ from the chamfer angle of the chamfer surface 18, as known in the art.

The cutting element substrate 12 may have a generally cylindrical shape, as shown in FIGS. 2 and 3. Referring to FIG. 3, the cutting element substrate 12 may have an at least substantially planar first end surface 22, an at least substantially planar second end surface 24, and a generally cylindrical lateral side surface 26 extending between the first end surface 22 and the second end surface 24.

Although the end surface 22 shown in FIG. 3 is at least substantially planar, it is well known in the art to employ non-planar interface geometries between substrates and diamond tables formed thereon, and additional embodiments of the present invention may employ such non-planar interface geometries at the interface between the substrate 12 and the multi-layer diamond table 14. Additionally, although cutting element substrates commonly have a cylindrical shape, like the cutting element substrate 12, other shapes of cutting element substrates are also known in the art, and embodiments of the present invention include cutting elements having shapes other than a generally cylindrical shape.

The cutting element substrate 12 may be formed from a material that is relatively hard and resistant to wear. For example, the cutting element substrate 12 may be formed from and include a ceramic-metal composite material (which are often referred to as "cermet" materials). The cutting element substrate 12 may include a cemented carbide material, such as a cemented tungsten carbide material, in which tungsten carbide particles are cemented together in a metallic binder material. The metallic binder material may include, for example, cobalt, nickel, iron, or alloys and mixtures thereof.

With continued reference to FIG. 3, the diamond table 14 may be disposed on or over the first end surface 22 of the cutting element substrate 12. The diamond table 14 may comprise a multi-layer diamond table 14, as discussed in further detail below. The diamond table 14 is primarily comprised of polycrystalline diamond material. In other words, diamond material may comprise at least about seventy percent (70%) by volume of the diamond table 14. In additional embodiments, the diamond material may comprise at least about eighty percent (80%) by volume of the diamond table 14, and in yet further embodiments, the diamond material may comprise at least about ninety percent (90%) by volume of the diamond table 14. The polycrystalline diamond material includes grains or crystals of diamond that are bonded together to form the diamond table. Interstitial regions or spaces between the diamond grains are filled with additional materials, as discussed below.

The multi-layer diamond table 14 may include a first layer or region of polycrystalline diamond material 30, a second layer or region of polycrystalline diamond material 32, and a barrier layer 34 comprising a barrier material disposed between the first layer or region of polycrystalline diamond material 30 and the second layer or region of polycrystalline diamond material 32. For example, as shown in FIG. 3, the multi-layer diamond table 14 may include a first layer of polycrystalline diamond material 30, a second layer of polycrystalline diamond material 32 on a side of the first layer of polycrystalline diamond material 30 opposite the cutting element substrate 12, and a barrier layer 34 disposed between the first layer of polycrystalline diamond material 30 and the second layer of polycrystalline diamond material 32.

Figure 4:
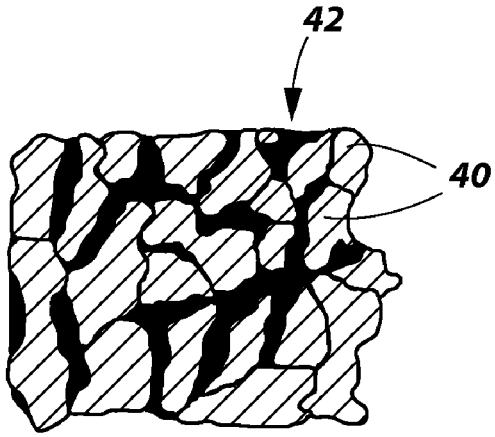
FIG. 4 is an enlarged view illustrating how a microstructure of a first layer or region of polycrystalline diamond material in the diamond table of the cutting element shown in FIGS. 2 and 3 may appear under magnification.

FIG. 4 is an enlarged view illustrating how a microstructure of the first layer of polycrystalline diamond material 30 in the diamond table 14 of the cutting element 10 shown in FIGS. 2 and 3 may appear under magnification. As shown in FIG. 4, the first layer of polycrystalline diamond material 30 includes diamond crystals or grains 40 that are bonded together. A catalyst material 42 (the shaded regions between the diamond crystals or grains 40) is disposed in interstitial regions or spaces between the diamond grains 40.

As used herein, the term "catalyst material" refers to any material that is capable of catalyzing the formation of intergranular diamond bonds in a diamond grit or powder during an HTHP process. By way of example, the catalyst material 42 may include cobalt, iron, nickel, or an alloy or mixture thereof. The catalyst material 42 may comprise other than elements from Group VIIIA of the Periodic Table of the Elements, including alloys or mixtures thereof.

FIG. 5 is an enlarged view like that of FIG. 4 illustrating how a microstructure of the second layer of polycrystalline diamond material 32 in the diamond table 14 of the cutting element 10 shown in FIGS. 2 and 3 may appear under magnification. As shown in FIG. 5, the second layer of polycrystalline diamond material 32 also includes diamond crystals or grains 40 that are bonded together. In the second layer of polycrystalline diamond material 32, however, an interstitial material 44 (the shaded regions between the diamond crystals or grains 40) that is different from the catalyst material 42, as previously described herein, may be disposed in the interstitial regions or spaces between the diamond grains 40. The interstitial material 44 may be at least substantially comprised by one or more elements from groups other than Group VIIIA of the Periodic Table of the Elements. In other words, the second layer of polycrystalline diamond material 32 may be at least substantially free of elements from Group VIIIA of the Periodic Table of the Elements. In yet other embodiments, the interstitial regions or spaces between the diamond grains 40 in the second layer of polycrystalline diamond material 32 may simply comprise air or gas filled voids or spaces.

Referring again to FIG. 3, the barrier layer 34 comprises a barrier material configured to act as a barrier to one or both of the catalyst material 42 in the first layer of polycrystalline diamond material 30 and the interstitial material 44 in the second layer of polycrystalline diamond material 32. In other words, the barrier layer 34 comprises a barrier material that will hinder diffusion, or selectively control the rate of diffusion of the catalyst material 42 in the first layer of polycrystalline diamond material 30 into the second layer of polycrystalline diamond material 32, and that will hinder diffusion, or selectively control the rate of diffusion of the catalyst material 44 in the second layer of polycrystalline diamond material 32 into the first layer of polycrystalline diamond material 30. It is understood that the barrier layer 34 may comprise a solid solution or a material compound formed during the HTHP process used to form the diamond table 14.

In some embodiments, the barrier layer 34 may comprise a layer of polycrystalline diamond material in which the interstitial spaces between the diamond grains 40 comprise or are filled with a barrier material (or a solid solution or material compound that includes a barrier material or serves as a barrier material). Diamond grains 40 in the barrier layer 34 on one side thereof may be bonded to diamond grains 40 in the first layer of polycrystalline diamond material 30, and diamond grains 40 in the barrier layer 34 on an opposing side thereof may be bonded to diamond grains 40 in the second layer of polycrystalline diamond material 32. In other words, grains of polycrystalline diamond material in the barrier layer 34 may form an intermediate layer of polycrystalline diamond material, and the intermediate layer of polycrystalline diamond material may be directly bonded to both diamond grains 40 in the first layer of polycrystalline diamond material 30 and diamond grains 40 in the second layer of polycrystalline diamond material 32 by diamond-to-diamond bonds.

Figure 6A:
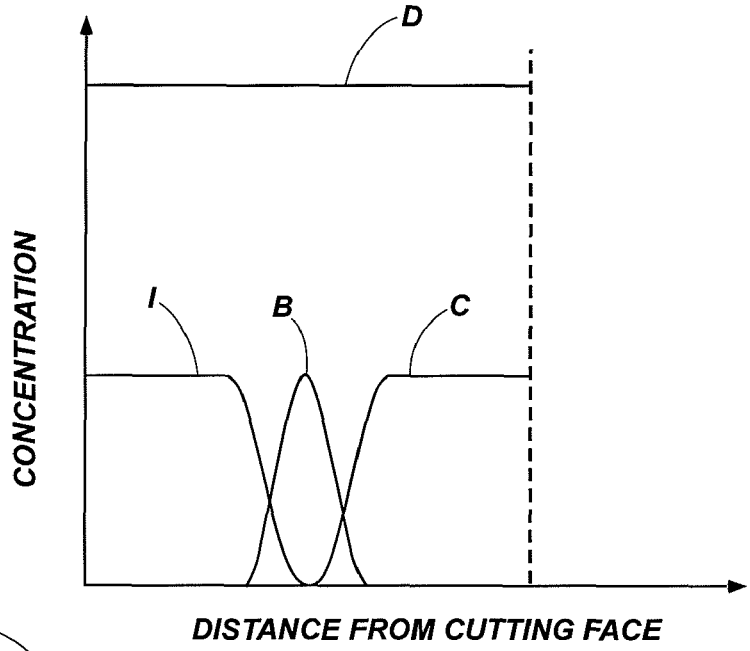
FIGS. 6A and 6B illustrate an enlarged cross-sectional view of the cutting element shown in FIGS. 2 and 3 and also include a graph of the concentration of various materials in the diamond table of the cutting element as a function of distance from a front cutting face of the diamond table.
Figure 6B:
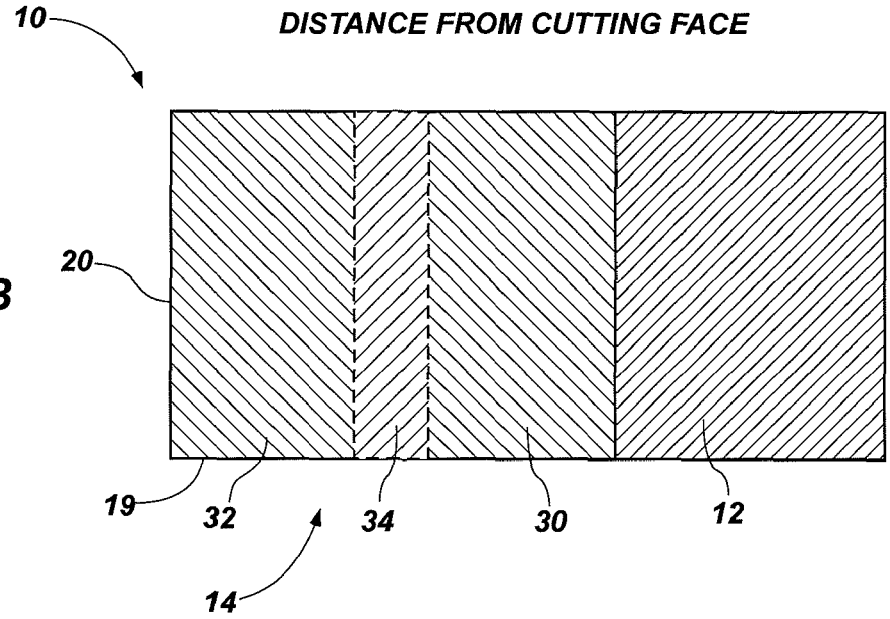

FIGS. 6A and 6B are used to further illustrate embodiments of cutting elements of the present invention. An enlarged partial view of a portion of the cutting element 10 is shown in FIG. 6B. The perspective of the cutting element 10 in FIG. 6B is rotated ninety degrees (90°) counter-clockwise relative to the perspective of FIG. 3. Although the first layer or region of polycrystalline diamond material 30, the second layer or region of polycrystalline diamond material 32, and the barrier layer 34 in the cutting element 10 are demarcated by dashed lines in FIG. 6B (and by solid lines in FIG. 3), in actuality, there may not be any clearly defined boundaries between the first layer or region of polycrystalline diamond material 30, the second layer or region of polycrystalline diamond material 32, and the barrier layer 34 in the cutting element 10.

FIG. 6A includes a graph illustrating the concentration of various materials within the diamond table 14 (FIG. 6B) of the cutting element 10 (FIG. 6B) as a function of distance from the front cutting face 20 (FIG. 6B) of the diamond table 14 of the cutting element 10. The concentration of diamond in the diamond table 14, which is represented by the line D in FIG. 6A, may be at least substantially constant between the front cutting face 20 thereof and the substrate 12. The concentration of catalyst material 42 in the diamond table 14, which is represented by the line C in FIG. 6A, is a maximum in the first layer or region of polycrystalline diamond material 30, and falls off to zero moving from the first layer or region of polycrystalline diamond material 30 (FIG. 6B) into the barrier layer 34 (FIG. 6B). The concentration of interstitial material 44 in the diamond table 14, which is represented by the line I in FIG. 6A, is a maximum in the second layer or region of polycrystalline diamond material 32 (FIG. 6B), and falls off to zero moving from the second layer or region of polycrystalline diamond material 32 into the barrier layer 34. The concentration of barrier material in the diamond table 14, which is represented by the line B in FIG. 6A, is a maximum at the center of the barrier layer 34, and falls off to zero moving in both directions from the barrier layer 34 into the first layer or region of polycrystalline diamond material 30 and from the barrier layer 34 into the second layer or region of polycrystalline diamond material 32.

As may be appreciated from FIGS. 6A and 6B, there may be some catalyst material 42 and some interstitial material 44 present within the barrier layer 34, and there may be some barrier material present within the first layer or region of polycrystalline diamond material 30 and the second layer or region of polycrystalline diamond material 32. However, the first layer or region of polycrystalline diamond material 30 may be at least substantially free of catalyst material 42 and the second layer or region of polycrystalline diamond material 32 may be at least substantially free of interstitial material 44.

The boundary between the first layer or region of polycrystalline diamond material 30 and the barrier layer 34 may be defined as the point at which the concentration of catalyst material 42 falls below the concentration of barrier material in the diamond table 14, moving from the first layer or region of polycrystalline diamond material 30 into the barrier layer 34. Similarly, the boundary between the second layer or region of polycrystalline diamond material 32 and the barrier layer 34 may be defined as the point at which the concentration of interstitial material 44 falls below the concentration of barrier material in the diamond table 14, moving from the second layer or region of polycrystalline diamond material 32 into the barrier layer 34.

Embodiments of cutting elements of the present invention may have a multi-layer diamond table that includes additional layers of polycrystalline diamond material, and, optionally, barrier layers, other than those described hereinabove.

Figure 7:
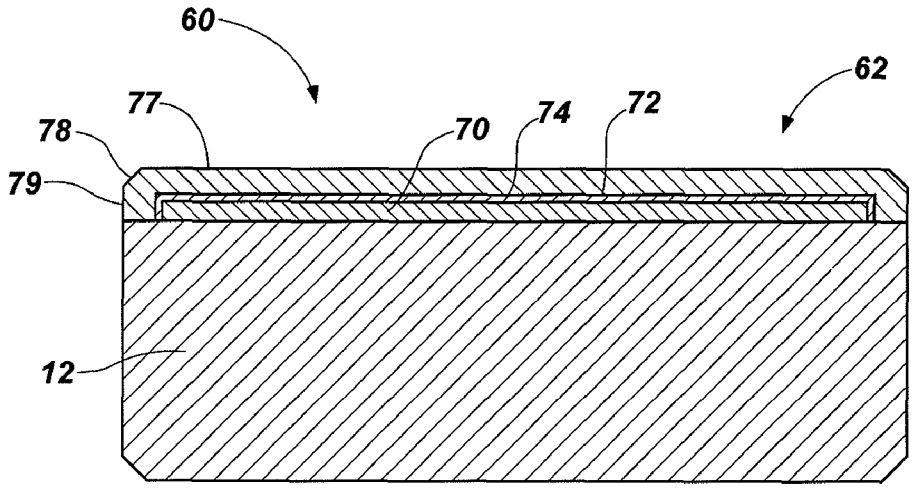
FIG. 7 is a cross-sectional view like that of FIG. 3 illustrating another embodiment of a cutting element of the present invention.

FIG. 7 illustrates another embodiment of a cutting element 60 of the present invention. The cutting element 60 is substantially similar to the cutting element 10 shown in FIGS. 2 and 3 and includes a multi-layer diamond table 62 having a first layer of polycrystalline diamond material 70, a second layer of polycrystalline diamond material 72, and a barrier layer 74 disposed between the first layer of polycrystalline diamond material 70 and the second layer of polycrystalline diamond material 72. The first layer of polycrystalline diamond material 70, the second layer of polycrystalline diamond material 72, and the barrier layer 74 may have compositions as previously disclosed with reference to the first layer of polycrystalline diamond material 30, the second layer of polycrystalline diamond material 32, and the barrier layer 34, respectively, of the cutting element 10 of FIGS. 2 and 3. The first layer of polycrystalline diamond material 70 and the barrier layer 74, however, may not be substantially planar.

As shown in FIG. 7, the first layer of polycrystalline diamond material 70 may not extend laterally to the peripheral edge of the substrate 12. The barrier layer 74 may conform to the surface of the first layer of polycrystalline diamond material 70, such that the barrier layer 74 has a cup shape, and the first layer of polycrystalline diamond material 70 is at least substantially covered by the barrier layer 74 and disposed within the cup shape of the barrier layer 74. The second layer of polycrystalline diamond material 72 may conform to the surface of the barrier layer 74 opposite the first layer of polycrystalline diamond material 70, such that the second layer of polycrystalline diamond material 72 also has a cup shape, and the barrier layer 74 and the first layer of polycrystalline diamond material 70 are disposed within the cup shape of the second layer of polycrystalline diamond material 72. In this configuration, a front cutting face 77, a chamfer surface 78, and an entire lateral side surface 79 of the multi-layer diamond table 62 may comprise exposed surfaces of the second layer of polycrystalline diamond material 72.

Embodiments of cutting elements of the present invention may offer enhanced thermal stability and, consequently wear resistance, by providing selected matter (air, gas, or solid interstitial material) in the interstitial voids or spaces between diamond grains in selected layers or regions of a multi-layer diamond table.

Embodiments of cutting elements of the present invention, such as the cutting element 10 previously described herein, may be used to form embodiments of earth-boring tools of the present invention.

Figure 8:
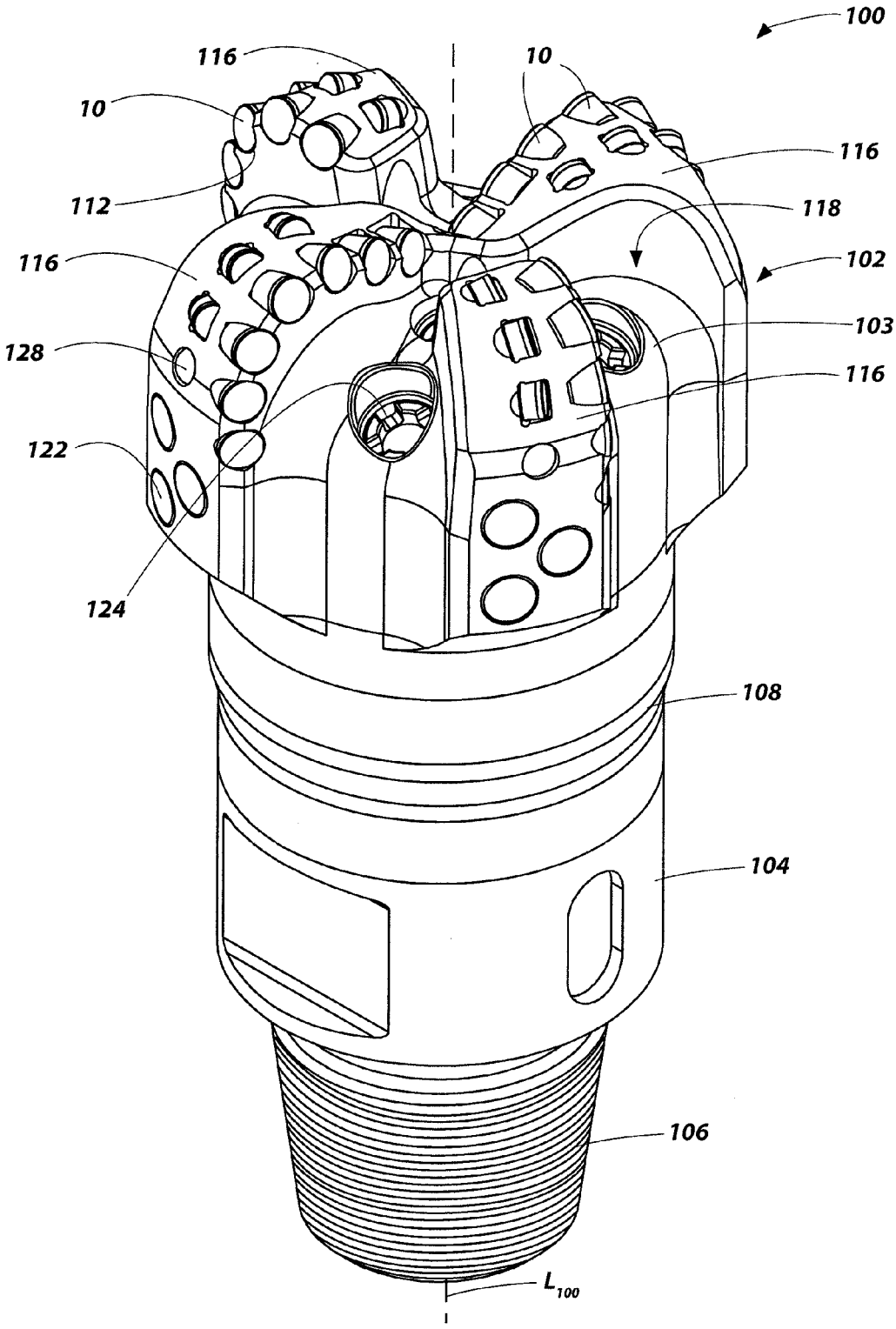
FIG. 8 is a perspective view of an embodiment of an earth-boring tool of the present invention that includes a plurality of cutting elements like those shown in FIGS. 2 and 3.

FIG. 8 is a perspective view of an embodiment of an earth-boring rotary drill bit 100 of the present invention that includes a plurality of cutting elements 10 like those shown in FIGS. 2 and 3. The earth-boring rotary drill bit 100 includes a bit body 102 that is secured to a shank 104 having a threaded connection portion 106 (e.g., an American Petroleum Institute (API) threaded connection portion) for attaching the drill bit 100 to a drill string (not shown). In some embodiments, such as that shown in FIG. 8, the bit body 102 may comprise a particle-matrix composite material, and may be secured to the metal shank 104 using an extension 108. In other embodiments, the bit body 102 may be secured to the shank 104 using a metal blank embedded within the particle-matrix composite bit body 102, or the bit body 102 may be secured directly to the shank 104.

The bit body 102 may include internal fluid passageways (not shown) that extend between the face 103 of the bit body 102 and a longitudinal bore (not shown), which extends through the shank 104, the extension 108, and partially through the bit body 102. Nozzle inserts 124 also may be provided at the face 103 of the bit body 102 within the internal fluid passageways. The bit body 102 may further include a plurality of blades 116 that are separated by junk slots 118. In some embodiments, the bit body 102 may include gage wear plugs 122 and wear knots 128. A plurality of cutting elements 10 as previously disclosed herein, may be mounted on the face 103 of the bit body 102 in cutting element pockets 112 that are located along each of the blades 116. In other embodiments, cutting elements 60 like those shown in FIG. 7, or any other embodiment of a cutting element of the present invention may be provided in the cutting element pockets 112.

The cutting elements 10 are positioned to cut a subterranean formation being drilled while the drill bit 100 is rotated under weight-on-bit (WOB) in a bore hole about centerline $L_{100}$.

Embodiments of cutting elements of the present invention also may be used as gauge trimmers, and may be used on other types of earth-boring tools. For example, embodiments of cutting elements of the present invention also may be used on cones of roller cone drill bits, on reamers, mills, bi-center bits, eccentric bits, coring bits, and so-called "hybrid bits" that include both fixed cutters and rolling cutters.

While the present invention has been described herein with respect to certain embodiments, those of ordinary skill in the art will recognize and appreciate that it is not so limited. Rather, many additions, deletions and modifications to the embodiments described herein may be made without departing from the scope of the invention as hereinafter claimed. In addition, features from one embodiment may be combined with features of another embodiment while still being encompassed within the scope of the invention as contemplated by the inventor.

What is claimed is:

1. A method of forming a cutting element for an earth-boring tool, comprising:

providing a first powder comprising diamond crystals adjacent a surface of a cutting element substrate;

providing a layer of barrier material adjacent the first powder on a side thereof opposite the cutting element substrate;

providing a second powder comprising diamond crystals adjacent the layer of barrier material on a side thereof opposite the first powder;

subjecting the cutting element substrate, the first powder, the layer of barrier material, and the second powder to high temperature and high pressure conditions and forming a first layer of polycrystalline diamond material from the first powder and a second layer of polycrystalline diamond material from the second powder;

catalyzing the formation of at least the first layer of polycrystalline diamond material from the first powder using catalytic material for catalyzing the formation of polycrystalline diamond material from individual diamond crystals;

infiltrating a portion of the layer of barrier material proximate the first layer of polycrystalline diamond material with the catalytic material;

hindering the catalytic material from migrating across the layer of barrier material; and infiltrating interstitial spaces between diamond crystals in the second layer of polycrystalline diamond material proximate the layer of barrier material with the barrier material.

2. The method of claim 1, wherein subjecting the cutting element substrate, the first powder, the layer of barrier material, and the second powder to high temperature and high pressure conditions comprises subjecting the cutting element substrate, the first powder, the layer of barrier material, and the second powder to a temperature greater than about 1,500° C. and a pressure greater than about 5.0 GPa.

3. The method of claim 2, wherein subjecting the cutting element substrate, the first powder, the layer of barrier material, and the second powder to high temperature and high pressure conditions comprises subjecting the cutting element substrate, the first powder, the layer of barrier material, and the second powder to a pressure greater than about 6.7 GPa.

4. The method of claim 1, further comprising forming the layer of barrier material to comprise an at least substantially solid disc of the barrier material.

5. The method of claim 1, further comprising forming the layer of barrier material to comprise a sheet or film of the barrier material.

6. The method of claim 5, further comprising selecting the barrier material to comprise a metal.

7. The method of claim 6, further comprising selecting the barrier material to comprise at least one of tantalum, titanium, tungsten, molybdenum, niobium, iron, and an alloy or mixture thereof.

8. The method of claim 1, further comprising selecting the cutting element substrate to comprise a cemented tungsten carbide material.

9. The method of claim 1, further comprising forming the cutting element substrate to have a generally cylindrical shape comprising an at least substantially planar end surface, and wherein providing the first powder adjacent the surface of the cutting element substrate comprises providing the first powder adjacent the at least substantially planar end surface of the cutting element substrate.

10. The method of claim 1, further comprising catalyzing the formation of the second layer of polycrystalline diamond material from the second powder using additional catalytic material for catalyzing the formation of polycrystalline diamond material from individual diamond crystals.

11. The method of claim 10, further comprising selecting the additional catalytic material to have a chemical composition differing from a chemical composition of the catalytic material used to catalyze the formation of the first layer of polycrystalline diamond material from the first powder.

12. The method of claim 10, further comprising removing catalytic material from interstitial spaces between diamond crystals in the second layer of polycrystalline diamond material.

13. The method of claim 12, further comprising removing at least substantially all catalytic material from the second layer of polycrystalline diamond material.

14. The method of claim 13, further comprising infiltrating the interstitial spaces between diamond crystals in the second layer of polycrystalline diamond material and a portion of the layer of barrier material proximate the second layer of polycrystalline diamond material with an at least substantially inert material.

15. The method of claim 13, wherein removing at least substantially all catalytic material from the second layer of polycrystalline diamond material comprises leaching at least substantially all catalytic material from the second layer of polycrystalline diamond material using an acid.

16. The method of claim 1, wherein hindering the catalytic material from migrating across the layer of barrier material comprises preventing the catalytic material from migrating completely across the layer of barrier material.

17. A method of forming a cutting element for an earth-boring tool, comprising:

forming a multi-layer diamond table on a surface of a substrate, the multi-layer diamond table comprising a first layer of polycrystalline diamond material and a second layer of polycrystalline diamond material, the second layer of polycrystalline diamond material located on a side of the first layer of polycrystalline diamond material opposite the substrate, forming the multi-layer diamond table comprising:

separating a first layer of diamond powder and a second layer of diamond powder with a layer of barrier material;

subjecting the first layer of diamond powder, the second layer of diamond powder, and the layer of barrier material to high temperature and high pressure conditions and forming the first layer of polycrystalline diamond material from the first layer of diamond powder and the second layer of polycrystalline diamond material from the second layer of diamond powder;

catalyzing the formation of the first layer of polycrystalline diamond material and the second layer of polycrystalline diamond material using at least one catalytic material; infiltrating a portion of the layer of barrier material proximate the first layer of polycrystalline diamond material with the at least one catalytic material; and infiltrating interstitial spaces between diamond crystals in the second layer of polycrystalline diamond material proximate the layer of barrier material with the barrier material;

removing catalytic material from interstitial spaces between diamond crystals in the second layer of polycrystalline diamond material; and infiltrating the interstitial spaces between diamond crystals in each of the second layer of polycrystalline diamond material and a portion of the layer of barrier material proximate the second layer of polycrystalline diamond material with an at least substantially inert material.

18. The method of claim 17, further comprising selecting the at least substantially inert material to comprise a material having a coefficient of thermal expansion less than about $4.5\times10^{-6}$ C.$^{-1}$ at temperatures between 0° C. and 400° C.

19. The method of claim 18, further comprising selecting the at least substantially inert material from the group consisting of silicon, copper, silver, gold, and alloys and mixtures thereof.

20. The method of claim 19, further comprising selecting the at least substantially inert material to comprise silicon.

21. The method of claim 17, wherein subjecting the first layer of diamond powder, the second layer of diamond powder, and the layer of barrier material, to high temperature and high pressure conditions comprises carburizing the layer of barrier material to form a carbide barrier material.

22. A cutting element for use in earth-boring tools, comprising:

a cutting element substrate;

a first layer of polycrystalline diamond material on the cutting element substrate and comprising catalytic material in interstitial spaces between diamond crystals in the first layer of polycrystalline diamond material;

a second layer of polycrystalline diamond material on a side of the first layer of polycrystalline diamond material opposite the cutting element substrate and comprising an at least substantially inert material in interstitial spaces between diamond crystals in the second layer of polycrystalline diamond material; and a barrier layer between the first layer of polycrystalline diamond material and the second layer of polycrystalline diamond material and comprising:

grains of polycrystalline diamond material;

barrier material in interstitial spaces between the grains of polycrystalline diamond material; and at least some of the at least substantially inert material in interstitial spaces between the grains of polycrystalline diamond material proximate the second layer of polycrystalline diamond material.

23. The cutting element of claim 22, wherein the cutting element substrate has a generally cylindrical shape comprising an at least substantially planar end surface, and wherein the first layer of polycrystalline diamond material is formed on the at least substantially planar end surface of the cutting element substrate.

24. The cutting element of claim 23, wherein the catalytic material is selected from the group consisting of iron, cobalt, nickel, and alloys and mixtures thereof.

25. The cutting element of claim 24, wherein the at least substantially inert material is selected from the group consisting of silicon, copper, silver, gold, and alloys and mixtures thereof.

26. The cutting element of claim 25, wherein the barrier material is selected from the group consisting of tantalum, titanium, tungsten, molybdenum, niobium, iron, and alloys and mixtures thereof.

27. The cutting element of claim 22, wherein the grains of polycrystalline diamond material in the barrier layer form an intermediate layer of polycrystalline diamond material, the intermediate layer of polycrystalline diamond material directly bonded to the first layer of polycrystalline diamond material and to the second layer of polycrystalline diamond material by diamond-to-diamond bonds.

28. The cutting element of claim 22, wherein lateral side surfaces of the first layer of polycrystalline diamond material and a surface of the first layer of polycrystalline diamond material opposite the cutting element substrate are at least substantially covered by the barrier layer.

29. The cutting element of claim 28, wherein surfaces of the barrier layer opposite the first layer of polycrystalline diamond material are at least substantially covered by the second layer of polycrystalline diamond material.

30. A cutting element for use in earth-boring tools, comprising:

a multi-layer diamond table on a surface of a cutting element substrate, the multi-layer diamond table comprising:

a first layer of polycrystalline diamond material on the cutting element substrate and comprising a catalytic material in interstitial spaces between diamond crystals in the first layer of polycrystalline diamond material; and a barrier layer on the first layer of polycrystalline diamond material and comprising:

a barrier material; and at least some of the catalytic material in a portion of the barrier layer proximate the first layer of polycrystalline diamond material; and a second layer of polycrystalline diamond material on the barrier layer and comprising:

an at least substantially inert material in interstitial spaces between diamond crystals in the second layer of polycrystalline diamond material; and at least some of the barrier material in the interstitial spaces between diamond crystals in the second layer of polycrystalline diamond material proximate the barrier layer.

31. The cutting element of claim 30, wherein the catalytic material is selected from the group consisting of iron, cobalt, nickel, and alloys and mixtures thereof.

32. The cutting element of claim 31, wherein the at least substantially inert material is selected from the group consisting of silicon, copper, silver, gold, and alloys and mixtures thereof.

33. The cutting element of claim 32, wherein the barrier layer comprises a barrier material selected from the group consisting of tantalum, titanium, tungsten, molybdenum, niobium, iron, and alloys and mixtures thereof.

34. An earth-boring tool, comprising:

a body; and at least one polycrystalline diamond cutting element attached to the body, the at least one polycrystalline diamond cutting element comprising:

a first layer of polycrystalline diamond material on a cutting element substrate and comprising catalytic material in interstitial spaces between diamond crystals in the first layer of polycrystalline diamond material;

a barrier layer on the first layer of polycrystalline diamond material and comprising:

a barrier material; and at least some of the catalytic material in a portion of the barrier layer proximate the first layer of polycrystalline diamond material; and a second layer of polycrystalline diamond material on the barrier layer and comprising:

an at least substantially inert material in interstitial spaces between diamond crystals in the second layer of polycrystalline diamond material; and at least some of the barrier material in the interstitial spaces between diamond crystals in the second layer of polycrystalline diamond material proximate the barrier layer.

35. The earth-boring tool of claim 34, wherein the catalytic material is selected from the group consisting of cobalt, iron, nickel and alloys and mixtures thereof, and wherein the barrier layer comprises a barrier material selected from the group consisting of tantalum, titanium, tungsten, molybdenum, niobium, iron, and alloys and mixtures thereof.

* * * * *